United States Patent [19]

Messerschmidt et al.

[11] 4,026,526

[45] May 31, 1977

[54] HOISTING GEAR

[75] Inventors: Dieter Messerschmidt, Hagen; Johannes Kluge, Wetter; Meinolf Schleyer, Unna, all of Germany

[73] Assignee: Demag Aktiengesellschaft, Germany

[22] Filed: Mar. 24, 1976

[21] Appl. No.: 669,971

[30] Foreign Application Priority Data

Mar. 25, 1975 Germany ..... 2513031

[52] U.S. Cl. ..... 254/168; 214/1 CM

[51] Int. Cl.[2] ..... B66D 1/00

[58] Field of Search ..... 254/168, 167, 173 R; 74/543, 491; 214/1 CM; 200/6 A, 61.85

[56] References Cited

UNITED STATES PATENTS

| | | | |
|---|---|---|---|
| 2,989,288 | 6/1961 | Smith | 254/168 |
| 3,310,290 | 3/1967 | Workman | 254/168 |

*Primary Examiner*—Frank E. Werner
*Assistant Examiner*—Kenneth Noland
*Attorney, Agent, or Firm*—Mandeville and Schweitzer

[57] ABSTRACT

An operating element is provided between a hoist motor and the load therefor, which incorporates an integral handle. The handle includes a right-hand and a left-hand toggle switch connection so that the hoist motor can be operated with either hand. The handle is horizontal and connected at each end to the operating element by a web to provide an open space for insertion of the hand. The space is essentially surrounded to protect the hand from injury. The casing of the operating element is comprised of an upper and lower half made of a light-weight resilient synthetic material. The casing surrounds a yoke comprised of a heavy-duty material, which yoke provides a direct connection between the hoist motor and the load. Also, the yoke is configured to partially surround the main operating switch in the element for protection and includes opposed integral stops for limiting the extent of movement of the switch.

17 Claims, 5 Drawing Figures

HOISTING GEAR

BACKGROUND OF THE INVENTION

U.S. Pat. No. 3,858,845 discloses a hoisting gear with hoisting element for load pickups, with the operating handle moving up and down with the load and with switches in the operating handle, for operating the hoisting unit motor. A basic load connecting element is provided, connected to the hoisting element, and incorporating the operating handle in the shape of a yoke. The basic element includes a rapid disconnect arrangement by means of which the load can be disconnected from the basic element. However, when connected to it, the connection is firm.

The hoisting gear previously disclosed to U.S. Pat. No. 3,858,845 has either a bar-shaped handle, which sometimes presents problems in manipulating the load, and the operator's hands remain unprotected, or an operating handle in the shape of a round yoke which has switches for the operation of the hoisting gear on one side only.

DESCRIPTION OF THE INVENTION

It is the object of the present invention to provide a basic load-connecting and operating element, which may be safely operated with the left hand, as well as the right hand, while at the same time providing easy access to the operating switches with either hand. This is achieved by providing the yoke-shaped operating handle with a straight or essentially straight horizontal handle piece, its ends being connected with the basic element via a web at each end, and by providing each web with a toggle lever. The toggle lever shafts, in turn, are connected via an angled connection gear, with a switch shaft arranged in the basic element body for operating a switch, and being interconnected via such switch shaft. When raising or lowering the basic operating element, the angle between hand and handle piece is changed. However, since the handle is straight, the basic position of the hand is not changed at different angles of the hand with the handle. The yoke protects the hand, with the exception of the thumb operating the toggle lever, as the major portion of the hand is behind the basic element body and inside the webs, thus in a protected area. The toggle levers arranged on both webs facilitate steering of the hoisting gear, either with the left or with the right hand, leaving one hand free for manipulating the load or other operations. The two toggle levers are connected to move in the same direction as the desired direction of movement of the load. Pressure on the upper half of each toggle lever causes, for example, the hoisting gear to lift the basic element.

As a further feature of the invention, the handle piece with webs and basic element, is divided into an upper and lower casing portion divided by a parting line, so that the tilt shaft, both angle gears and the main switch shaft with switch insert are all housed in one of the halves of the basic operating element, so that the other half can serve as a firm support for the parts installed in the basic element. The two casing halves are comprised of a resilient synthetic resin, so that no damage results from the basic element striking delicate articles, or in damage to the basic element itself striking something.

In order to provide the basic element with the stability required to carry a load, a yoke facing the handle piece is attached in the lower half of the casing, while the main operating switch is inserted into the yoke for protection. The yoke is made of heavy-duty material such as, steel, for example, and may be mounted with reinforcements in the area of its upper and lower connections. An adapter for the hoisting motor connection is provided at the top of the yoke, and an adapter for the load pickup is provided on the bottom of the yoke, so that the load capacity is satisfactorily transmitted via yoke and adapters, which are made of a heavy-duty material, from the hoisting motor to the load pickup, even though the casing is manufactured of a relatively lightweight synthetic material and only serves to protect the delicate operating parts, mechanically and electrically. The connection for the hoisting element is in a truncated-conical cap, so that the electrical cable connection between the basic element and the hoisting gear and motor may be coiled on the cap when the basic element moves upwardly.

The yoke in the basic element includes integral stops for the main operating switch, in order to ensure that its movement does not exceed a permissible degree.

The angle gears referred to above are formed by level gear segments and are attached on the main switch shaft and on the tilt shafts of the toggle levers. The switch shaft rests at each end in common bearings, together with one of the toggle shafts, such bearings being inserted between mounts in the lower half of the casing. The tiltable toggle shafts extend into recesses for the shafts provided in the switch operating buttons or levers and are pressed into the latter. The switch levers extend into guides in the bearings with bearing journals surrounding the toggle shafts, so that the switch levers, together with the tiltable toggle shafts, angle gears, switch shaft and main operating switch form a structural unit. When installed, each switch lever is supported on its respective web via a support cam at the end opposite the bearing journal therefor. The web connects the basic element with the handle piece. To avoid misdirection, each switch lever has a separating ridge on its actuating surface, parallel with the tilt shaft. Without looking, pressure may be applied, either in an upward or downward direction.

As purely illustrative of the apparatus of the invention, one may note the attached drawings, illustrating the invention incorporated into a hoist arrangement for placing the motor into an automobile.

DETAILED DESCRIPTION OF THE INVENTION

Figure 1:
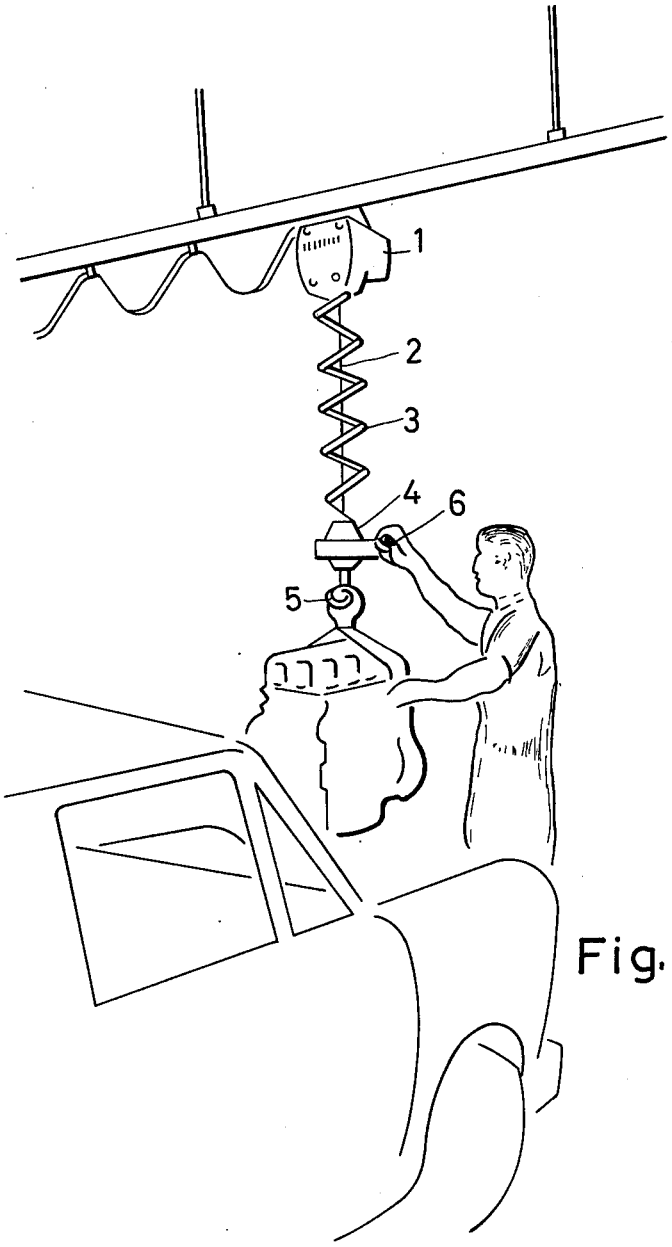
FIG. 1 illustrates the basic arrangement of the operating element of the invention in relation to a hoist controlled thereby, the load, and the operator.

Referring to the drawings, in which like references refer to like parts throughout the several views thereof, FIG. 1 shows a worker lowering a motor into a passenger vehicle with the thumb of the right hand operating switch lever 6, covered by the thumb, for operating hoisting gear 1, while the left hand directs the motor hanging from pickup 5 in the shape of a load hook. Basic element 4 is connected with hoisting gear 1 via hoisting chain 2 around which operating cable 3 is coiled.

Figure 2:
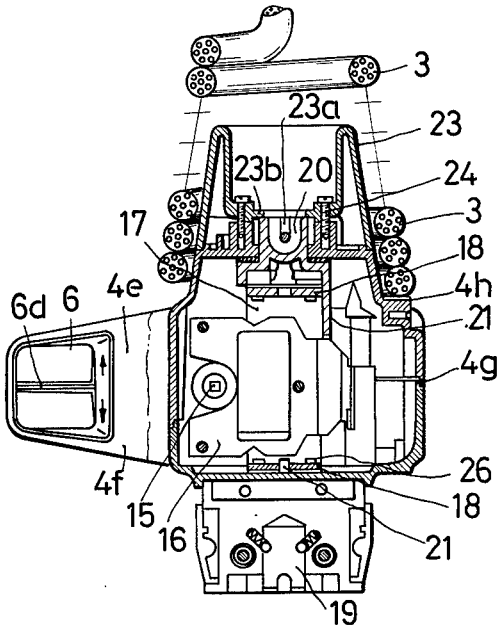
FIG. 2 is a vertical section through the operating element of the invention.

FIG. 2 shows the basic element with upper casing half 4*e*, and lower casing half 4*f*, which meet at 4*g*. The casings are connected to each other by connecting screws 25 indicated in FIG. 3. The casings are shaped to incorporate the various operating parts of basic element 4, and include upper and lower halves of the handle therefor, including webs 4*d* and straight handle piece 4*c*. Truncated-conical cap 23 is attached to upper casing half 4*e* by means of cap screws 24. Cable 3 is coiled on cap 23 when basic element 4 is moved upwardly. Webs 4*d* leading to handle piece 4*c*, together with a projection 4*h* opposite webs 4*d*, prevent cable 3 from falling down over basic element 4. The two casing halves 4*e* and 4*f*, with webs 4*d* and handle piece 4*c*, as well as cap 23, may be comprised of a resilient synthetic material.

Figure 4:
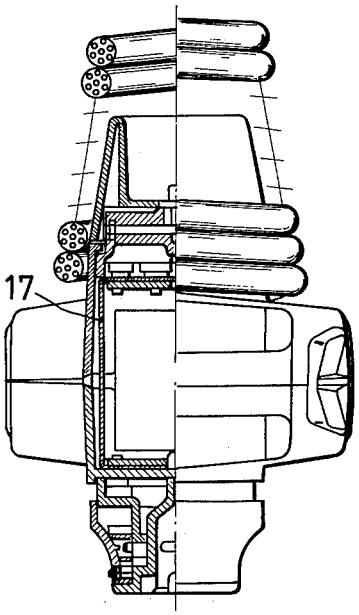
FIG. 4 is a front view of the operating element of FIG. 2, partially in section.
Figure 3:
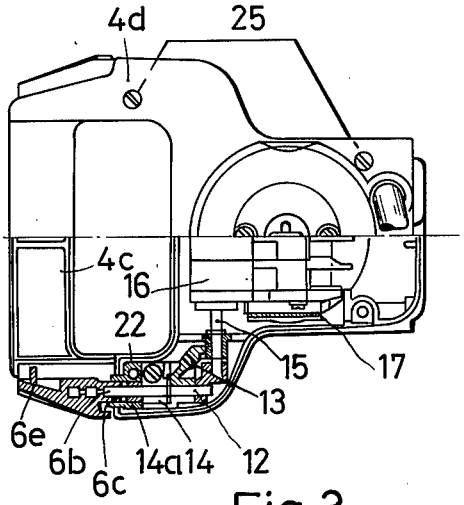
FIG. 3 is a top plan view of the operating element of FIG. 2, partially in section.
Figure 5:
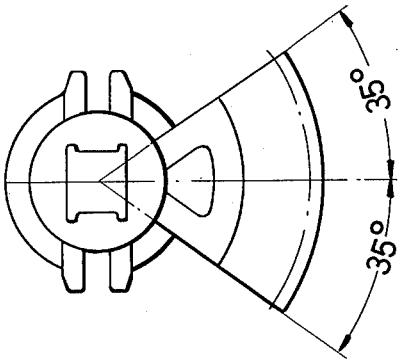
FIG. 5 is a schematic illustration of the bevel gear segment of the angle gear connection of the invention, as viewed from the front.

Toggle levers 6 mounted in webs 4*d* can be seen in FIGS. 2 through 4. FIG. 2 shows a switch lever 6 with a centrally located, horizontal separation ridge 6*d*, providing a sensory difference for the operator between the directions indicated by arrows. In FIG. 3, tilt shaft 12 is shown extending into shaft recess 6*b* of toggle switch lever 6. Guidance of the lever is with bearing journal 6*c* in guide 14*a* of bearing 14, and support cam 6*e* supports toggle lever 6 in web 4*d*. Switch shaft 15 extends into bearing 14 at right angles with tilt shaft 12. Tilt shaft 12 and switch shaft 15 are connected to each other via angle gear 13 in the form of bevel gear segments, their possible tilt angle on both sides amounting to 24°. The angle of tilt shown in FIG. 5 of 35° is only partially utilized. Bearing 14 adheres to web 4*d* and is positioned on mounting 22 in the lower casing half 4*f*.

Switch shaft 15 extends into switch 16, which consists of several cam discs for the necessary contacts and terminals for cable 3. Switch 16 extends into yoke 17, made of steel or other materials capable of withstanding loads. The extent of movement of main switch 16 is defined by stops 21 integral with yoke 17. Yoke 17 is firmly connected to universal adapter 19 for attachment to interchangeable loads, and adapter 20 connected to hoist chain 2. The two adapters 19 and 20 are connected to yoke 17 by tension screws 26, and to reinforcements 18 on yoke 17. Adapter 20 for hoist cable or chain 2 is configured to provide a corresponding opening 23*a* of cap 23 in the bottom 23*b* thereof to accommodate connection to cable or chain 2.

While the apparatus herein disclosed forms a preferred embodiment of the invention, the invention is not limited to those specific forms of apparatus, and changes can be made therein without departing from the scope of the invention, which is defined in the appended claims.

We claim:

1. A gear hoist arrangement for lifting loads, comprising a. a hoist unit with a motor;
b. an operating element for said hoist unit;
c. cable connections between said hoist unit and said operating element;
d. an operating handle on said element;
e. switch means on said handle for operating said hoist unit;
f. load connecting means extending from the bottom of said element; the improvement characterized by
g. said operating handle being yoke-shaped with a horizontal elongated handle piece;
h. a web at each end of said handle piece for connection to said operating element;
i. a toggle switch lever in each said web;
j. a tiltable switch lever shaft connected to each toggle switch lever;
k. a switch mounted on said operating element;
l. a switch shaft mounted on said switch; and
m. an angle gear means interconnecting one of said tiltable switch lever shafts to each end of said switch shaft.

2. The apparatus of claim 1, further characterized by a. a casing for said operating element;
b. said casing being divided into an integral upper half and an integral lower half joined centrally of said operating element; and
c. said casing upper half and lower half each having an integral extension forming an upper and lower half of said handle piece and each of said webs.

3. The apparatus of claim 2, further characterized by a. said casing means being comprised of a resilient synthetic material.

4. The apparatus of claim 2, further characterized by a. a bearing positioned at each end of said switch shaft; and
b. each of said bearings providing bearing surfaces for one end of the adjacent one of said tiltable switch lever shafts.

5. The apparatus of claim 4, further characterized by a. each said bearing being mounted in said casing lower half.

6. The apparatus of claim 4, further characterized by a. each said bearing having a bearing guide for receiving its respective tiltable switch lever shaft;
b. a bearing journal surrounding each said tiltable switch lever shaft in its respective bearing guide.

7. The apparatus of claim 6, further characterized by a. each of said toggle switch levers having an integral cam surface extension for engaging its respective web at one end thereof; and
b. a second bearing journal adjacent each toggle switch lever at the ends thereof opposite said integral cam surface; and
c. each of said second bearing journals supporting one end of their respective toggle switch lever.

8. The apparatus of claim 1, further characterized by a. a supporting yoke mounted in said operating element, with the open side thereof facing said handle; and
b. said switch being mounted in the open side of said yoke.

9. The apparatus of claim 8, further characterized by a. said yoke being comprised of a heavy load bearing material.

10. The apparatus of claim 8, further characterized by a. reinforcement means mounted on the upper and lower horizontal extensions of said yoke.

11. The apparatus of claim 8, further characterized by a. an adapter connected to the top of said yoke for connection to said hoist unit cable connections; and b. said load connecting means includes an adapter connected to the bottom of said yoke for connection to a load.

12. The apparatus of claim 11, further characterized by a. said upper and lower adapters being comprised of a heavy-duty synthetic material.

13. The apparatus of claim 11, further characterized by a. a truncated cone-shaped element attached to the top of said operating element for coiling said cable connections in the upper portions of said operating element.

14. The apparatus of claim 8, further characterized by a. stops positioned adjacent each side of said switch defining the extent of movement thereof in each direction; and b. said stops being integral with said yoke.

15. The apparatus of claim 1, further characterized by a. said angle gear means comprising bevel gear segments.

16. The apparatus of claim 1, further characterized by a. a recess in each said toggle switch lever for receiving its respective tiltable switch lever shaft; and b. each said shaft engaging its respective recess in a press-fit.

17. The apparatus of claim 1, further characterized by a. the operating surface of each toggle switch lever having a ridge down the middle thereof for identifying the actuating direction of movement thereof.

* * * * *